US005943538A

United States Patent [19]

Choi

[11] Patent Number: 5,943,538

[45] Date of Patent: Aug. 24, 1999

[54] TONER SUPPLYING DEVICE FOR DEVELOPING UNIT

[75] Inventor: Bong-Hwan Choi, Suwon, DPR of Korea

[73] Assignee: SamSung Electronics Co., Ltd., Suwon, Rep. of Korea

[21] Appl. No.: 08/883,225

[22] Filed: Jun. 26, 1997

[30] Foreign Application Priority Data

Jun. 26, 1996 [KP] DPR of Korea ..... 96-24069

[51] Int. Cl.[6] ..... G03G 15/08

[52] U.S. Cl. ..... 399/258; 399/260

[58] Field of Search ..... 399/119, 222, 399/252, 254, 256, 258, 260, 261, 274, 279, 286; 248/690, 692, 628, 27.1, 27.3, 67.7, 214, 215, 229.15, 618

[56] References Cited

U.S. PATENT DOCUMENTS 5,095,341 3/1992 Yoshida et al. ..... 399/284
5,389,732 2/1995 Sekino ..... 399/103
5,465,140 11/1995 Nakamura et al. ..... 399/254
5,470,635 11/1995 Shirai et al. ..... 428/131
5,473,417 12/1995 Hirano ..... 399/285
5,655,175 8/1997 Oshida ..... 399/27

*Primary Examiner*—Arthur T. Grimley
*Assistant Examiner*—George Edward Wendal, Jr.
*Attorney, Agent, or Firm*—Robert E. Bushnell, Esq.

[57] ABSTRACT

A toner supplying device for a developing unit in an image forming apparatus, including a toner loading unit for loading a toner therein; a toner feed outlet installed on a lower portion of the toner loading unit; an agitator for agitating and conveying the toner to an upper portion of a feed roller, the agitator being rotatably provided to the toner loading unit; a feed bar for attaching the toner and periodically activating the toner on the upper portion of the feed roller, the feed bar being connected with a link; a developing roller for developing a latent toner image from an electrostatic latent image formed on the surface of the photosensitive drum, the developing roller and the feed roller being installed in a lower frame within the developing unit; and a blade for uniformly regulating the toner at a certain height, the blade being installed on an upper portion of the developing roller.

9 Claims, 5 Drawing Sheets

TONER SUPPLYING DEVICE FOR DEVELOPING UNIT

CLAIM OF PRIORITY

This application makes reference to, incorporates the same herein, and claims all benefits accruing under 35 U.S.C. §119 arising from an application for a *TONER SUPPLYING DEVICE FOR DEVELOPING UNIT* earlier filed in the Korean Industrial Property Office on Jun. 26, 1996 and there duly assigned Serial No. 24069/1996.

1. Field of the Invention

The present invention relates to an image forming apparatus of an electrophotographic processor such as a laser beam printer, a copier and a plain paper facsimile machine, more particularly, to a toner supplying device for a developing unit in which a flow of toner for forming an image is smoothly provided, thereby achieving a clear and fine image.

2. Description of the Related Art

Image forming apparatuses widely use an electrophotographic developing method, and such electrophotographic apparatuses generally include a copier, a laser beam printer and a plain paper facsimile machine. The electrophotographic apparatus forms an invisible electrostatic latent image on the surface of a photosensitive drum. In the electrophotographic apparatus, the latent image on the surface of the photosensitive drum is developed and visualized by means of a toner, thereby transferring the visualized image on printing papers.

However, the earlier electrophotographic apparatus as mentioned above, has a problem when the toner is agitated by the agitator installed in the toner loading unit and is conveyed to the feed roller so as to be supplied to the developing roller. At this time, the toner on the upper portion of the feed roller is solidified in a static state. This prevents the toner from being uniformly charged, decreasing image density.

SUMMARY OF THE INVENTION

Therefore, it is an object to provide a toner supplying device for a developing unit of an electrophotographic apparatus in which the toner on an upper portion of a feed roller is periodically activated, thereby achieving a constant electric charge of the toner and uniform image density for a clear and fine image.

To accomplish this object, according to the present invention, there is provided a toner supplying device for a developing unit in an electrophotographic apparatus, comprising a toner loading unit for loading a toner therein; a toner feed outlet installed on a lower portion of the toner loading unit; an agitator for agitating and conveying the toner to an upper portion of a feed roller, the agitator being rotatably installed in the toner loading unit; a feed bar for attaching the toner and periodically activating the toner on the upper portion of the feed roller; a developing roller for developing the toner on electrostatic latent image formed on the surface of the photosensitive drum, the developing roller and the feed roller being installed in a lower frame within the developing unit; and a blade for uniformly regulating the toner at a certain height, the blade being installed on an upper portion of the developing roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
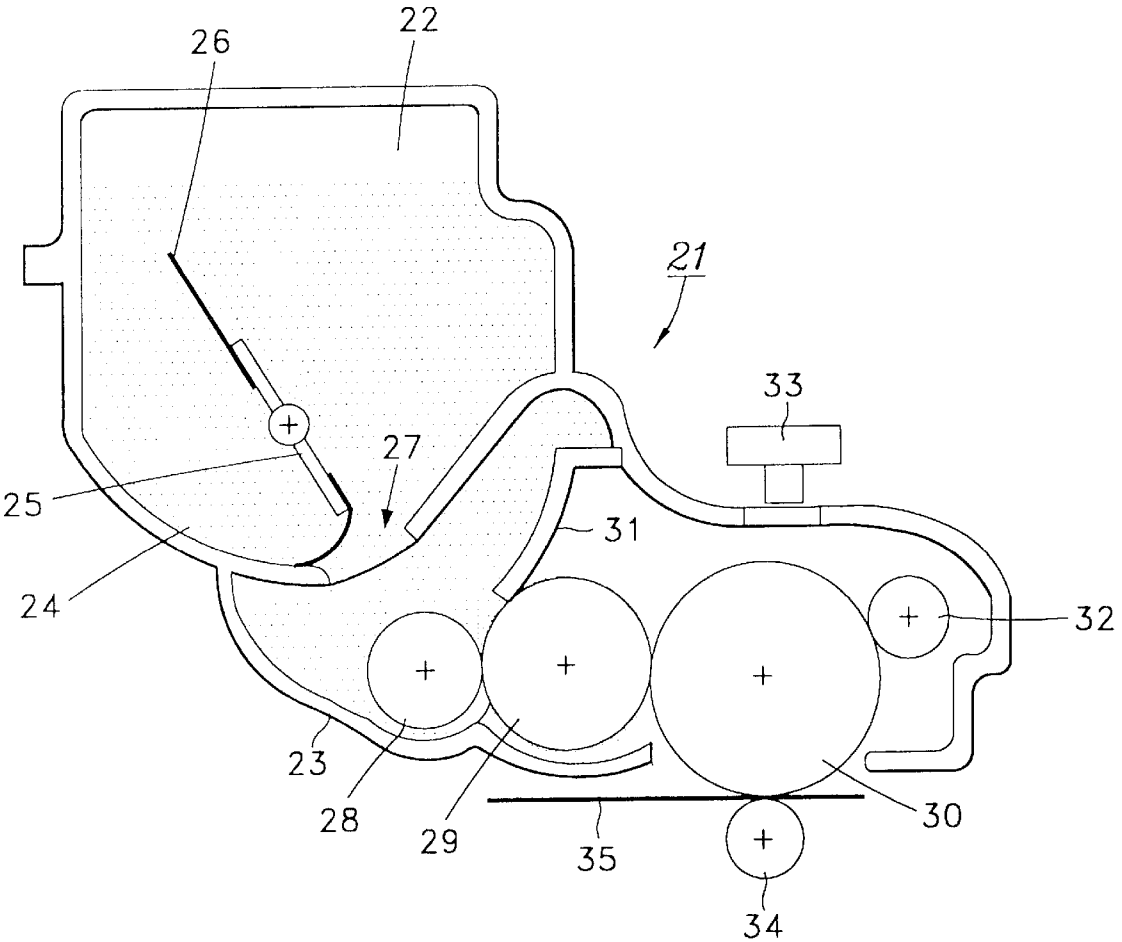
FIG. 1 is a side view illustrating a construction of an earlier toner supplying device for a developing unit.
Figure 2:
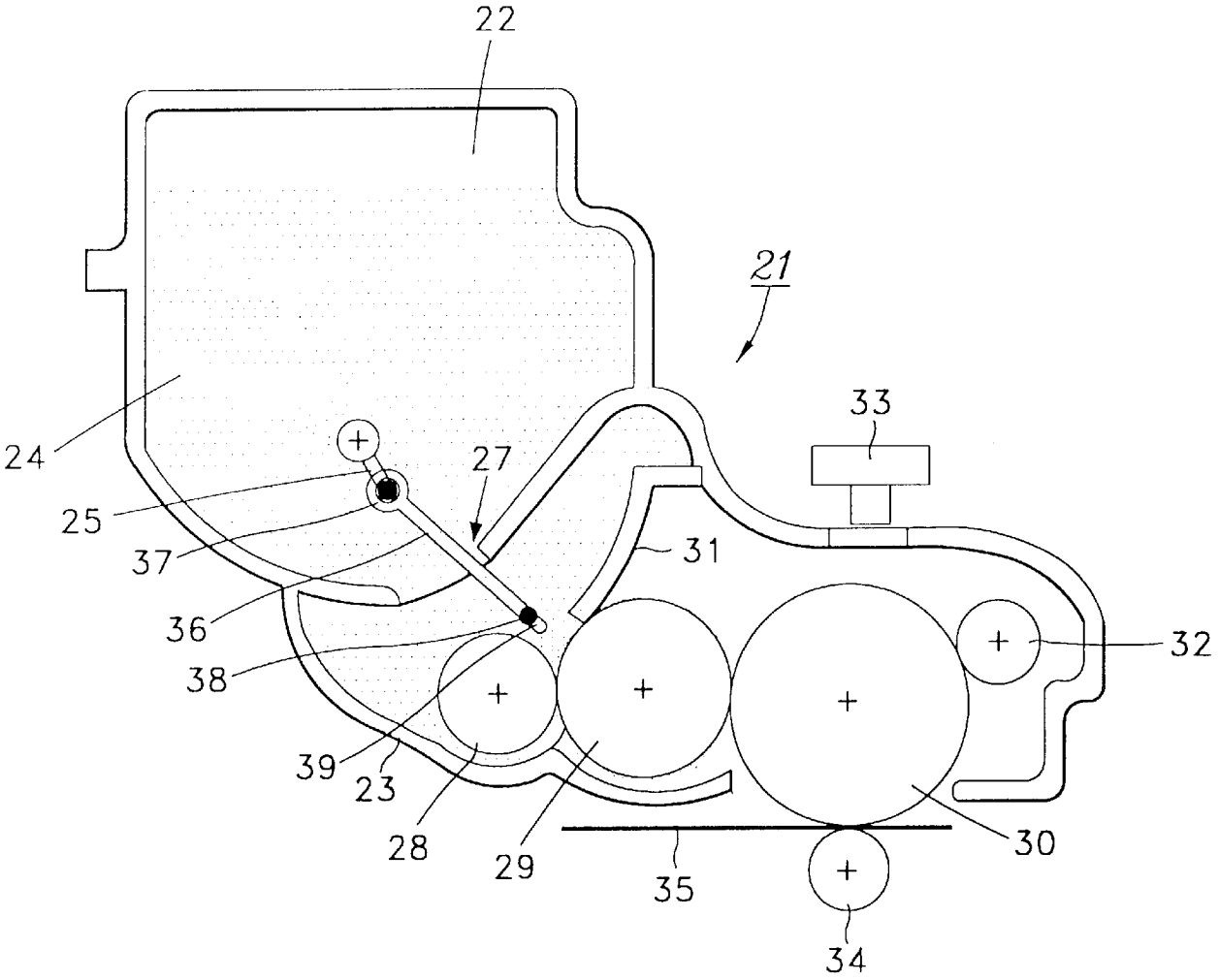
FIG. 2 is a side view illustrating a construction of a toner supplying device for a developing unit according to the present invention.
Figure 3:
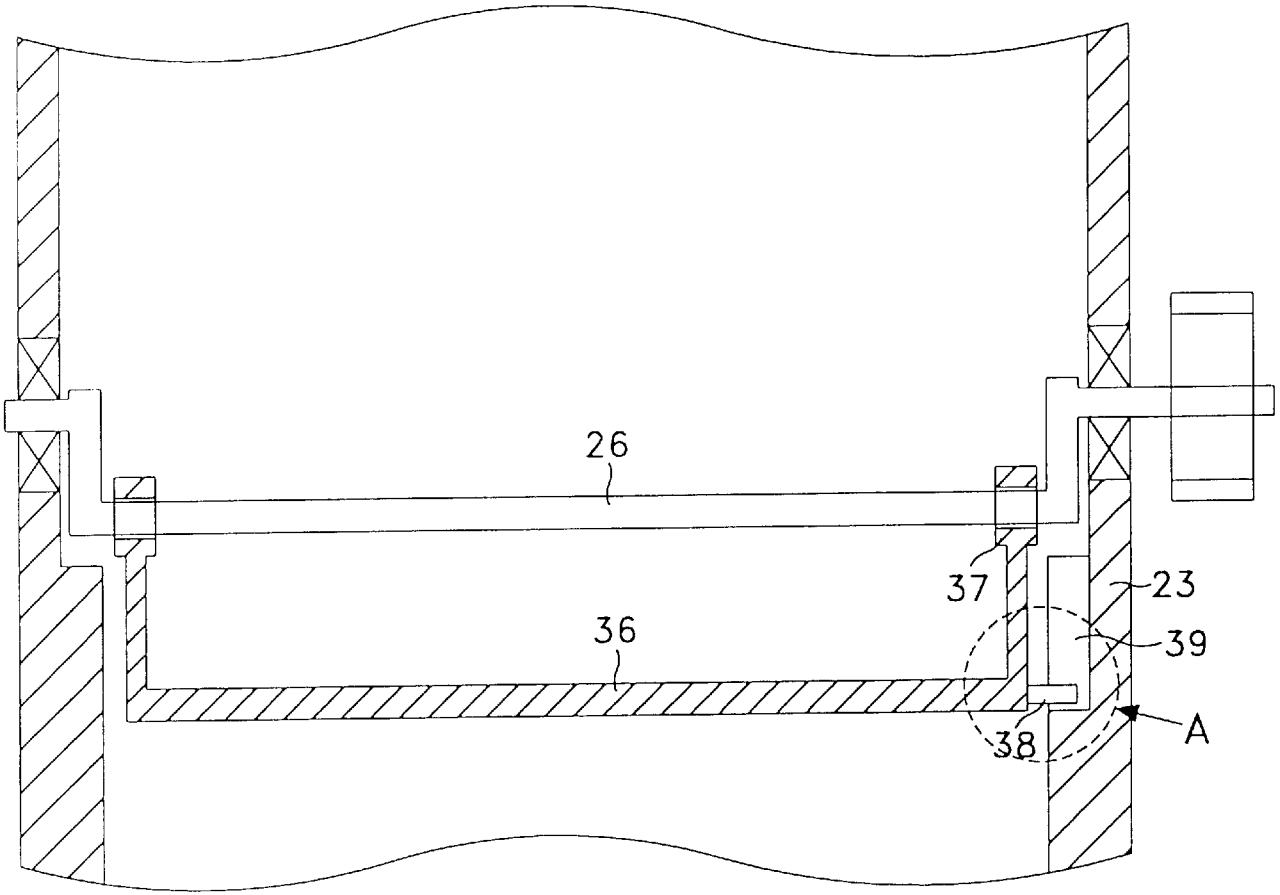
FIG. 3 is a sectional view illustrating a construction of an agitator installed in a developing unit according to the present invention.
Figure 4:
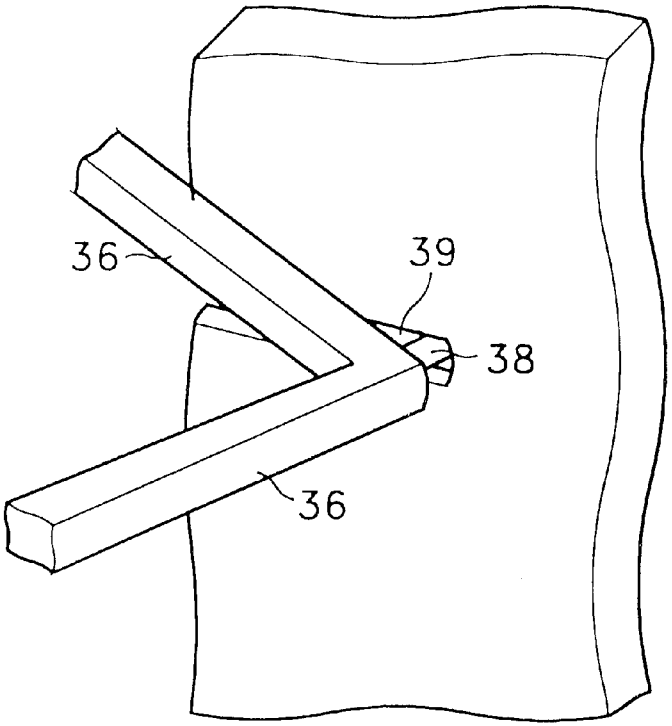
FIG. 4 is a detailed diagram illustrating the portion A of FIG. 3.
Figure 5:
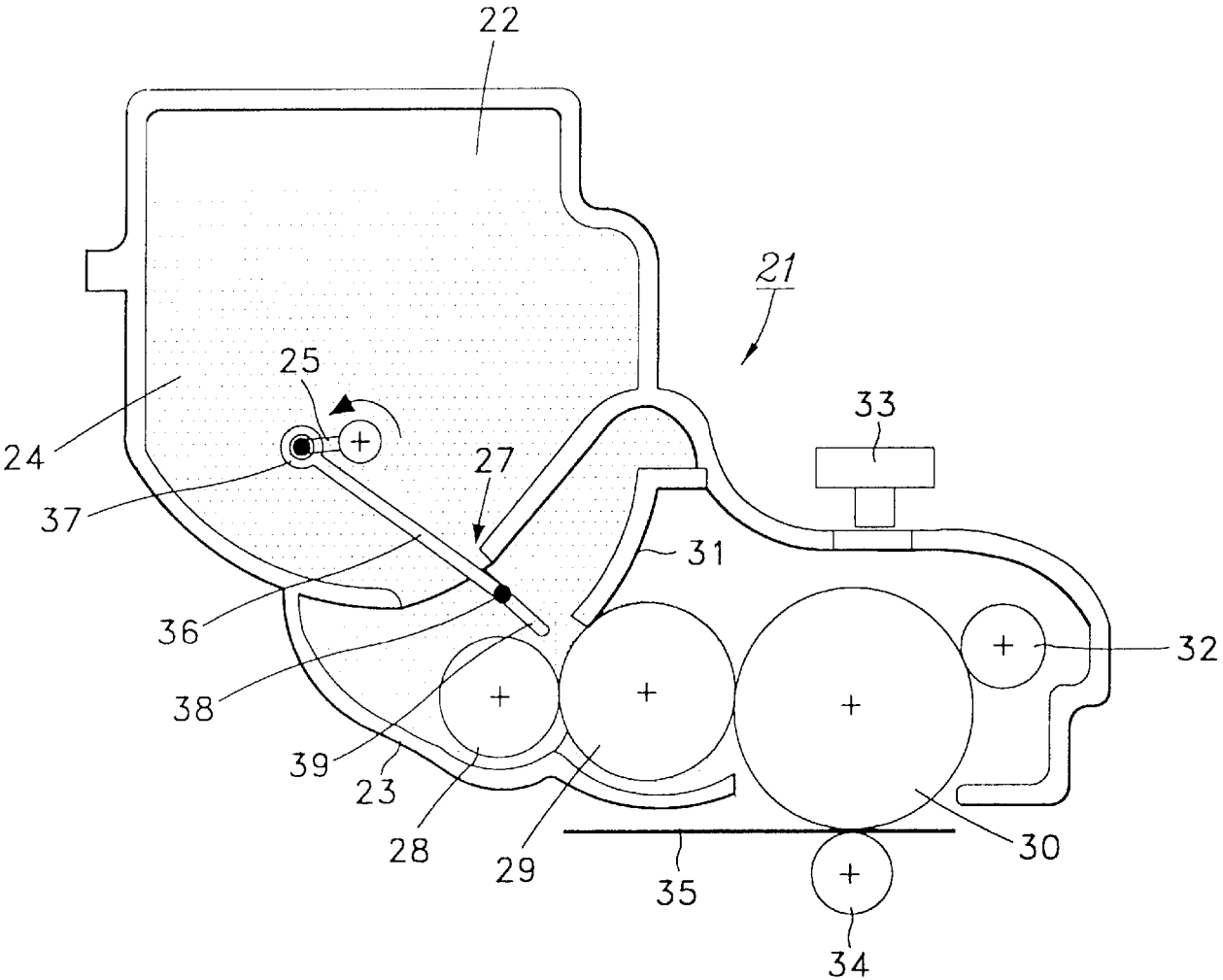
FIG. 5 is a side view illustrating an operating state according to the present invention.

FIG. 1 is a side view illustrating a construction of an earlier toner supplying device for a developing unit. The developing unit 21 of the electrophotographic apparatus as shown in FIG. 1, consists of a toner loading unit 22 for loading a toner 24 therein, a toner feed outlet 27 installed on a lower portion of the toner loading unit 22, an agitator 25 for agitating and conveying the toner 24 to a feed roller 28 through the toner feed outlet 27, which is rotatably provided to the toner loading unit 22, a film 26 for supplying the toner 24 to the feed roller 28, which is fixed on both ends of the agitator 25, a developing roller 29 for developing the toner 24 on the electrostatic latent image formed on the surface of the photosensitive drum 30, which is along with the feed roller 28 provided to a lower frame 23 within the developing unit, and a blade 31 for uniformly regulating the toner 24 at a certain height, which is provided to an upper portion of the developing roller 29.

The film 26 fixed on the agitator 25 is thin and has a flexible tension. When the agitator 25 is rotated, the film 26 is contacted with an inner portion of the toner loading unit 22 while being curved. When the agitator 25 is moving while being located in toner feed outlet 27, the toner 24 is supplied to the feed roller 28 through the toner feed outlet 27.

In the above electrophotographic apparatus, as the agitator 25 of the toner loading unit 22 within the upper portion of the developing unit 21 is rotated, film 26 fixed on the agitator 25 is contacted with the inner portion of the toner loading unit 22 while being curved. This agitates and prevents the toner 24 from being attached into the inner portion of the toner loading unit 22.

When the film 26 is placed on the toner feed outlet 27 by rotation of the agitator 25, the film 26 is stretched by its own tension in a curved state, thereby supplying the toner 24 to the upper portion of the feed roller 28 through the toner feed outlet 27.

At this time, the toner 24 is supplied to the developing roller 29 by rotation of the feed roller 28 installed in a lower frame 23 and the toner 24 on the surface of the developing roller 29 is uniformly regulated at a certain height by a blade 31 above. At this time, a charge roller 32 is electrically operated, thereby uniformly charging the surface of the photosensitive drum 30. The electrostatic latent image is formed on the charged surface of the photosensitive drum 30 through an exposing unit 33 by rotation of the photosensitive drum 30. The electrostatic latent image is transferred by way of the developing roller 29, and then is uniformly developed and visualized by means of the toner 24. Then, a toner image on the surface of the photosensitive drum 30 is transferred onto the printing papers 35 fed from a paper feeding cassette by a high pressure of the transfer roller 34.

Thereafter, when the printing papers are conveyed and passed between a heating roller and a pressure roller, the toner image is fixed on a sheet of the printing papers by heat and pressure, and the printed sheet of the printing papers is conveyed to an eject tray.

Turning to FIGS. 2–5, a toner supplying device according to the present invention is illustrated. The developing unit 21 of the electrophotographic apparatus comprises: the toner loading unit, or restorer, 22 for loading the 24 toner therein, the toner feed outlet 27 installed on one portion of the toner loading unit 22; the agitator 25 for agitating and conveying the toner 24 to the feed roller 28 through the toner feed outlet 27, which is rotatably provide to the toner loading unit 22; a feed bar 36 for agitating and propelling the toner 24 and periodically activating the toner 24 accumulated on the upper portion of the feed roller 28, which is connected to the agitator 25 by means of a link 37; the developing roller 29 for developing a latent toner image from on the electrostatic latent image formed on the surface of the photosensitive drum 30, which is along with the feed roller 28 provided to the lower frame 23 within the developing unit 21; and the blade 31 for uniformly regulating the toner 24 at a certain height, which is provided to the upper portion of the developing roller 29.

Feed bar, or C-shaped member, 36 and both links 37, located on each end of the feed bar, combine to form a "C" shaped member that is attached to the agitator 25. Also, a guide projecting part 38 installed on both ends of a vertical hem of the feed bar 36 can be inserted into a guide groove 39 of the upper portion of the lower frame 23 installed with the feed roller 28, thereby being guided.

When the agitator 25 is rotated, the feed bar 36 where the vertical hem thereof is placed on the upper portion of the feed roller 28, is moved back and forth while guiding the guide projecting part, or pole, 38 into the guide groove 39 within the lower frame 23, thereby supplying the toner 24 to the upper portion of the feed roller 28. At the same time, the feed bar 36 is moved back and forth while scratching the toner 24 into the toner feed outlet 27, thereby periodically activating the toner 24 accumulated on the upper portion of said feed roller 28. As a result, a constant electric charge of the toner and uniform image density can be achieved for a clear and fine image.

The effects and operations according to the invention will be as follows. In the electrophotographic apparatus, in the case that the toner 24 is provided to the toner loading unit 22 formed on the upper portion of the developing unit 21, the toner 24 is agitated by the agitator 25, thereby generating a static electricity by friction so as to make the electric charge be constant. The agitated toner 24 is supplied to the lower portion of the developing unit 21 through the toner feed outlet 27 of the toner loading unit 22 and is supplied to the developing roller 29 by rotation of the feed roller 28 within the lower frame 23.

At this time, as the agitator 25 of the toner loading unit 22 is rotated, the toner 24 is agitated and the feed bar 36, loosely connected to the agitator 25 by means of the link 37, is moved back and forth, thereby supplying the toner 24 within the toner loading unit 22 to the upper portion of the feed roller 28 through the toner feed outlet 27.

Also, the feed bar 36 is moved back and forth while guiding the guide projecting part 38 to the guide groove 39 within the lower frame 23, causing the toner 24 accumulated on the upper portion of the feed roller 28 to be pushed toward the developing roller 29 and again to be scratched into the toner feed outlet 27. As a result, the toner 24 accumulated on the upper portion of the feed roller 28 is periodically activated so as to have the electric charge of the toner 24 to be constant.

As the agitator 25 is continually rotated, preventing the toner 24 from being tangled while generating a static electricity by friction, the toner 24 is continually supplied to the feed roller 28 in a constant electric charge. At this time, the rotation of the feed roller 28 installed in the lower frame 23 causes the toner 24 around the feed roller 28 to be supplied to the developing roller 29, thereby causing the toner 24 to have a constant electric charge characteristic. Also, the toner 24 is periodically moved toward the developing roller 29, so that the electric charge of the toner 24 can be uniformly performed.

In such state as above, the toner 24 on surface of the developing roller 29 is uniformly regulated at a certain height by the blade 31 above. At this time, the surface of the photosensitive drum 30 is uniformly electrically charged by an electric operation of the charge roller 32. The electrostatic latent image is formed on the charged surface of the photosensitive drum 30 through the exposing unit 33. The latent image is uniformly developed and visualized by means of the toner 24 while passing the developing roller 29 being rotated. Then printing papers 35 installed in a paper feeding cassette are fed to the paper feed roller. And, a toner image on surface of the photosensitive drum 30 is transferred to the printing papers 35 by the high pressure of the transfer roller 34. Then, when the printing papers 35 are conveyed between the heating roller and the pressure roller, the toner image is fixed on a sheet of the printing papers 35 by the heat and the pressure. The printed sheet is then conveyed to a paper ejecting tray, so that the clear, fine image can be achieved.

The present invention as above has advantage in which the feed bar is via the link connected to the agitator rotatably installed in the toner loading unit of the developing unit and is moved back and forth on the upper portion of the feed roller, thereby periodically activating the toner accumulated on the upper portion of the feed roller so as to prevent the toner from being accumulated. Also, a constant electric charge of the toner and uniform image density of the developing roller can be achieved for a clear and fine image.

While there have been illustrated and described what are considered to be preferred embodiments of the present invention, it will be understood by those skilled in the art that various changes and modifications may be made, and equivalents may be substituted for elements thereof without departing the true scope of the present invention.

What is claimed is:

1. A toner supplying device for a developing unit in an image forming apparatus, said developing unit including a feed roller, said device comprising:

a toner loading unit for loading a toner therein;

a toner feed outlet provided on a lower portion of said toner loading unit;

an agitator for agitating and conveying said toner to an upper portion of the feed roller, said agitator being rotatably mounted in said toner loading unit;

a feed bar for attaching said toner and periodically activating said toner on the upper portion of the feed roller;

a developing roller for developing a latent toner image from an electrostatic latent image formed on the surface of a photosensitive drum, said developing roller being installed with said developing unit; and a blade for uniformly regulating said toner at a certain height, said blade being installed on an upper portion of said developing roller;

wherein said feed bar is connected to said agitator and has a C-shape, said feed bar being moved back and forth proximate to the upper portion of said feed roller.

2. The device of claim 1, said feed bar being a plurality of radially outwardly extending projections.

3. A toner supplying device for a developing unit in an image forming apparatus, said developing unit including a feed roller, said device comprising:

a toner loading unit for loading a toner therein;

a toner feed outlet provided on a lower portion of said toner loading unit;

an agitator for agitating and conveying said toner to an upper portion of the feed roller, said agitator being rotatably mounted in said toner loading unit;

a feed bar for attaching said toner and periodically activating said toner on the upper portion of the feed roller;

a developing roller for developing a latent toner image from an electrostatic latent image formed on the surface of a photosensitive drum, said developing roller being installed within said developing unit; and a blade for uniformly regulating said toner at a certain height, said blade being installed on an upper portion of said developing roller;

wherein said feed bar is connected to said agitator so that a guide projecting part installed on a vertical hem thereof can be inserted into a guide groove of an upper portion of a lower frame of said developing unit, thereby to be guided.

4. The device as claimed in claim 3, wherein, when said agitator is rotated, said feed bar is periodically moved back and forth while guiding said guide projecting part into said guide groove of said lower frame, causing said toner to be supplied to the upper portion of said feed roller, and said agitator is again moved back and forth while scratching said toner toward said toner feed outlet, causing said toner accumulated on the upper portion of said feed roller to be periodically activated, thereby causing an electric charge of said toner to be constant, said feed bar being placed on the upper portion of said feed roller.

5. A toner supplying device for a developing unit in an image forming apparatus, comprising:

a toner loading unit for loading toner therein, said toner loading unit having an upper portion and a lower portion;

a toner feed outlet provided on said lower portion of said toner loading unit;

a feed roller having an upper portion and a lower portion, said feed roller being located in said lower portion of said toner loading unit;

an agitator disposed within said toner loading unit for agitating and conveying said toner to said upper portion of said feed roller;

a feed bar for attaching said toner and periodically activating said toner on said upper portion of said feed roller, said feed bar being connected to said agitator and extending through said toner feed outlet;

a photosensitive drum for forming an electrostatic latent image thereon;

a developing roller for transferring said toner from said feed roller to said photosensitive drum, said developing roller being located in said lower portion of said toner loading unit;

a blade for uniformly regulating the thickness of said toner on said developing roller; and a link comprising a plurality of radially extending projections for attaching said agitator to said feed bar.

6. A toner supplying device for a developing unit in an image forming apparatus, comprising:

a toner loading unit for loading toner therein, said toner loading unit having an upper portion and a lower portion;

a toner feed outlet provided on said lower portion of said toner loading unit;

a feed roller having an upper portion and a lower portion, said feed roller being located in said lower portion of said toner loading unit;

an agitator disposed within said toner loading unit for agitating and conveying said toner to said upper portion of said feed roller;

a feed bar for attaching said toner and periodically activating said toner on said upper portion of said feed roller, said feed bar being connected to said agitator and extending through said toner feed outlet;

a photosensitive drum for forming an electrostatic latent image thereon;

a developing roller for transferring said toner from said feed roller to said photosensitive drum, said developing roller being located in said lower portion of said toner loading unit; and a blade for uniformly regulating the thickness of said toner on said developing roller;

wherein said feed bar is connected to said agitator so that a guide projecting part installed on a vertical hem thereof can be inserted into a guide groove of an upper portion of said lower frame installed with said feed roller, thereby to be guided.

7. The device as claimed in claim 6, wherein, when said agitator is rotated, said feed bar is periodically moved back and forth while guiding said guide projecting part into said guide groove of said lower frame, causing said toner to be supplied to the upper portion of said feed roller, and said agitator is again moved back and forth while scratching said toner toward said toner feed outlet, causing said toner accumulated on the upper portion of said feed roller to be periodically activated, thereby causing an electric charge of said toner to be constant, said feed bar being placed on the upper portion of said feed roller.

8. A developing unit for an image forming apparatus, comprising:

a housing;

a reservoir contained in said housing for storing a toner;

an agitator that moves in a rotary fashion to mix said toner;

an outlet formed in said reservoir, said toner passing through said outlet;

a C-shaped member pivotally attached to said agitator and moveable through said outlet;

a feed roller rotatably mounted in said housing for conveying toner emitted by said reservoir;

a developing roller rotatably disposed proximate to said feed roller for receiving said toner conveyed by said feed roller and for transporting said toner to a photosensitive drum; and a blade disposed adjacent to said developing roller for uniformly regulating a height of said toner on said developing roller;

said C-shaped member moving in a reciprocating fashion through said outlet to supply fresh toner to an upper portion of said feed roller.

9. The developing unit of claim 8, further comprising:

an inner surface of said housing bearing a groove proximate to said C-shaped member;

said C-shaped member having a pole projecting from said C-shaped member; and said pole slidably engaging said groove causing said C-shaped member to reciprocate through said outlet in said reservoir.

* * * * *